United States Patent [19]

Fowler

[11] Patent Number: 4,934,286

[45] Date of Patent: Jun. 19, 1990

[54] APPARATUS AND METHOD FOR THE DISPOSAL OF WASTE

[76] Inventor: Benjamin P. Fowler, 805 S. Country Club, LaPorte, Tex. 77057

[21] Appl. No.: 398,246

[22] Filed: Aug. 24, 1989

[51] Int. Cl.[5] ..... F23G 00/00

[52] U.S. Cl. ..... 110/346; 110/229; 431/29; 48/197 A; 48/111; 48/65

[58] Field of Search ..... 110/229, 346; 48/197 A, 48/197 R, 65, 111; 431/29, 30, 31

[56] References Cited

U.S. PATENT DOCUMENTS

| | | | |
|---|---|---|---|
| 2,921,840 | 1/1960 | Johnson et al. | 48/65 |
| 3,575,119 | 4/1971 | Marr, Jr. | 110/8 |
| 3,841,239 | 10/1974 | Nakamura et al. | 110/8 C |
| 3,918,374 | 11/1975 | Yamamoto et al. | 110/8 E |
| 4,157,896 | 6/1979 | Wainer | 48/65 |
| 4,162,654 | 7/1979 | Spitz et al. | 110/212 |
| 4,253,406 | 3/1981 | Spitz et al. | 110/241 |
| 4,316,878 | 2/1982 | Akune et al. | 110/238 |
| 4,448,588 | 5/1984 | Cheng | 48/111 |
| 4,597,771 | 7/1986 | Cheng | 48/111 |
| 4,604,165 | 8/1986 | Calderon | 48/65 |
| 4,644,877 | 2/1987 | Barton et al. | 110/250 |
| 4,665,841 | 5/1987 | Kish | 110/234 |
| 4,667,609 | 5/1987 | Hardison et al. | 110/236 |
| 4,695,448 | 9/1987 | Anthony | 423/659 |
| 4,759,300 | 7/1988 | Hansen et al. | 110/229 |
| 4,819,571 | 4/1989 | Hallett | 110/346 |
| 4,823,742 | 4/1989 | Davis et al. | 110/229 |
| 4,848,249 | 7/1989 | LePori et al. | 48/197 A |

OTHER PUBLICATIONS

Young, "Molecular Sieve Adsorption in Liquified Natural Gas Plant Pre-Purification", *Union Carbide Molecular Sieves.*

*Primary Examiner*—Edward G. Favors
*Assistant Examiner*—Denise L. Ferensic
*Attorney, Agent, or Firm*—Harrison & Egbert

[57] ABSTRACT

A process for the disposal of waste comprising the steps of passing a waste into a sealed container, purging the sealed container of oxygen, heating the interior of the sealed container to a temperature of greater than 2,700° F. so as to convert the waste into a gas, and transmitting the gas into a storage vessel. An inert gas is introduced into the interior of the sealed container so as to displace oxygen from within the sealed container. The inert gas is ideally nitrogen. The interior of the sealed container is heated by induction heating. The gas is transferred through a water filter so as to remove the carbon component of the gas. The water filtered gas is then passed through a sodium hydroxide filter so as to remove the chlorine component of the gas. The gas is then sieved so as to separate the various gaseous components for individual storage.

17 Claims, 1 Drawing Sheet

APPARATUS AND METHOD FOR THE DISPOSAL OF WASTE

TECHNICAL FIELD

The present invention relates to apparatus and methods for the disposal of waste. More particularly, the present invention relates to those apparatus and methods in which the waste product is heated to a high temperature such that the waste is destroyed. Additionally, the present invention relates to apparatus and methods for waste disposal that gasify waste in an oxygen-free environment.

BACKGROUND ART

Garbage and waste are produced in communities in great quantities. This garbage and waste must be disposed of in a variety of ways. The disposal of various kinds of garbage and waste in large quantities in cities is one of the important new administrative problems facing city government. Typical methods for the disposal of garbage include discharging garbage into the sea for reclamation and burying garbage underground. However, there are great problems, such as pollution of sea water and difficulty in getting land, associated with these methods. The general trend at present is directed toward the disposal of garbage by complete incineration. However, and unfortunately, the prevailing technique for the disposal of garbage by incineration, a method is used which burns garbage on fire grates with large quantities of air supplied, thus creating a number of associated problems.

It has been found that the use of large quantities of air produces large quantities of exhaust gases, thereby creating and exacerbating air pollution. Since the combustion temperature of garbage is relatively low, the residue of burnt garbage cannot be made completely harmless. A great deal of environmental pollution is caused by such effluents from this incineration process. Since the combustion of garbage on fire grates is unstable, the efficiency of heat recovery is low and it is difficult to effectively use the heat generated by the combustion and garbage. Additionally, vast space is occupied by the fire grates. This requires a large area for the combustion site. Furthermore, there is a difficulty in getting the sites for the construction of large incinerating plants because of the environmental problems associated therewith.

Recently, disposal methods have been proposed which attempt to solve some of the problems associated with thermal decomposition. Essentially, the garbage is introduced into an incinerator with the heat necessary for thermal decomposition so as to produce a generated slag and gas. There are two processes that are available—a process which uses external heat as an intense heat source necessary for thermal decomposition and a process which utilizes heat generated by the partial oxidation of the garbage with air or oxygen supplied. In the former process, since an external heat is used, the problem lies in economy. In the latter process, since combustion gas gets mixed with generated gas, the calorific value of generated gas is decreased, disadvantageously making the usefulness of the generated gas inferior to that of the former process.

Another problem facing city governments is the disposal o±toxic or hazardous materials, such as polychlorinated biphenyls (PCB's). These are toxic and hazardous compounds whose use is being withdrawn or prohibited because of the irreversible harm to the health and the environment. These materials must be managed and disposed of effectively. In addition to polychlorinated biphenyls, there are also organophosphorous, organonitrogen, and organometallic compounds, as well as other materials, that exist in massive quantities and demand effective means of disposal. The majority of the toxic compounds are in a complex matrix format often combining organic and inorganic compounds or fractions, and in these cases, little or no disposal technology is available.

Various methods have been used for disposing of these toxic wastes, including thermal destruction, chemical detoxification, long-term encapsulation and specific landfill methods. With the exception of high temperature incineration, little success has been demonstrated for the safe disposal of highly toxic or extremely persistent waste, such as PCB's. The methods that have been tried have either not been able to handle anything but homogenous waste feed streams or they have only been able to handle relatively low concentrations of toxic compounds in the waste materials. Further, very few of the disposal methods tried to date have been able to develop to operate on a commercial scale.

Of the many methods tried for the disposal of toxic or hazardous wastes, thermal destruction has been the most promising. However, the toxic waste materials are usually very stable organic molecules, and they require long dwell times at high temperatures to effect thermal destruction. Some combustion or incineration systems can achieve the necessary conditions, but the facilities required are very large scale, and often the products of the combustion process present as much of a disposal problem as the original toxic wastes.

In the past, attempts have been made to use electric plasma arcs to destroy toxic wastes. An electric plasma arc system, being essentially pyrolytic, overcomes many of the deficiencies of an incineration or combustion process. The volume of gaseous products produced is much less. As a result the equipment is substantially smaller in scale. Laboratory demonstrations have shown that a plasma arc is capable of atomizing and ionizing toxic organic compounds, and these atoms and ions usually recombine into simple products. While residual toxic materials are formed, these can be captured, so that no significant amount of toxic material is released to the environment.

Unfortunately, such pyrolytic destruction of waste materials is not suitable for a commercially viable system. Often, the gaseous products that are released into the environment can contribute to various forms of air pollution. In addition, the release of such gases causes concern among the various regulatory authorities in control of the destruction of such toxic materials. Furthermore, and importantly, such plasma arch, pyrolytic methods of waste destruction are extremely costly processes. The cost of the power needed to operate lasers, plasma arcs, or various other methods, cannot be justified on a large scale garbage disposal basis. Furthermore, the by-products of the combustion process are not acquired for later sale or cost offset.

Various United States patents have attempted to address the issue of waste disposal by high temperature incineration process. U.S. Pat. No. 4,665,841, issued on May 19, 1987, describes a municipal trash destruction system in which hydraulic systems move the rubbish, garbage, and other municipal trash into a processor. The processor includes a trash processing zone, a fractionating system, a combustion zone, a heating exchange zone, a waste heat recovery system, and a precipitator for cleaning the emissions prior to release into the atmosphere. U.S. Pat. No. 4,644,877, issued on Feb. 24, 1987, describes the pyrolytic destruction of toxic and hazardous waste materials. The waste materials are fed into a plasma arc burner where they are atomized and ionized. These materials are then discharged into a reaction chamber to be cooled and recombined into product gas and particulate matter. The product gas is then extracted from the recombining products using a scrubber. The product gas may then be burned and utilized as a fuel. U.S. Pat. No. 4,695,448 issued on Sept. 22, 1987, describes the dissociating of toxic compounds by an electric arc (e.g. 12,000° F.) in an airtight chamber charged with oxygen. U.S. Pat. No. 4,759,300, issued on July 26, 1988, shows a method and apparatus for the pyrolysis of waste products. In this invention, the waste materials to be pyrolyzed are efficiently dehydrated prior to introduction into the pyrolysis retort using microwaves generated by a large microwave generator. After the waste material is dried, the initial ignition of the material is accomplished by using a high intensity laser beam. Laser ignition is continued until sufficient methane and other volatile gases are produced for burning in a burner unit to sustain the pyrolysis reaction. U.S. Pat. No. 4,667,609, issued on May 26, 1987, describes the destruction of soil contaminated with hydrocarbons by passing the material through a sealed, negatively pressurized, high temperature furnace. The temperature in one zone of this process is maintained at 2,900° F. so as to effectively destroy the contaminating hydrocarbons. U.S. Pat. No. 3,575,119 shows an apparatus fOr disintegrating and incinerating a concentrated slurry of solid organic material. Material passes through an arcuate tunnel having a plurality of arc electrodes spaced therealong. These electrodes cause the temperature to abruptly raise from about 2,000° F. to about 15,000° F. so as to dissolve the bonds between the carbon and the other atoms.

It is an object of the present invention to provide a waste disposal system that cleanly burns the waste material.

It is another object of the present invention to provide a waste disposal system that economically pays for itself by the recovery of the gaseous by-products of the combustion process.

It is a further object of the present invention to provide a waste disposal system in which the waste is burned in an oxygen-free environment.

It is still a further object of the present invention to provide a waste disposal system in which the waste is reacted with a water filter and a sodium hydroxide filter so as to remove the harmful by-products of the combustion process.

These and other objects and advantages of the present invention will become apparent from a reading of the attached specification and appended claims.

SUMMARY OF THE INVENTION

The present invention is a process for the disposal of waste that comprises the steps of: (1) passing a waste into a sealed container; (2) purging the sealed container of oxygen; (3) heating the interior of the sealed container to a temperature of greater than 2,700° F. so as to convert the waste into a gas; and (4) transmitting the gas into a storage container.

The step of purging comprises introducing an inert gas into the interior of the sealed container so as to displace the oxygen from within the sealed container. The oxygen is specifically expelled from the sealed container while the inert gas is being introduced. The inert gas is, ideally, nitrogen. The oxygen content of the interior of the sealed container is then analyzed while the inert gas is introduced into the sealed container.

The sealed container is heated by applying heat to the sealed container by induction heating. The interior of the sealed container is, ideally, heated to between 2,700 and 3,500° F.

After the waste is transformed into a gaseous composition, this gaseous composition is transferred through a water filter so as to remove a portion of the carbon component of the gaseous composition. This gaseous composition is then passed through a sodium hydroxide filter so as to remove a portion of the chlorine component of the gas. After the gas is passed to the storage vessel, the gas is sieved so as to separate the various gaseous components from the gas by-products of the combustion. Each of the separated gaseous components is then transferred into a separate container for storage.

The present invention is also an apparatus for the disposal of waste that comprises a sealed container, a waste transport line communicating with the interior of the sealed container so as to deliver waste to the interior of the sealed container, an inert gas injector communicating with the interior of the sealed container so as to deliver an inert gas to the interior of the sealed container, a heater affixed adjacent to the sealed container so as to cause the interior of the sealed container to exceed 2,700° F. in temperature, and a storage vessel that is connected to the sealed container so as to receive the gaseous by-products from the sealed container. This apparatus includes an oxygen removal system that is connected to the sealed container so as to selectively remove oxygen from the interior of the sealed container upon the introduction of the inert gas.

A water filter is connected between the storage vessel and the sealed container so as to filter the carbon components from the gaseous by-products. A sodium hydroxide filter is connected between the storage vessel and the sealed container so as to filter the chlorine components of the gaseous by-products. The storage vessel has a molecular sieve attached thereto for the selected removal of the desired gases from the storage vessel. A plurality of stainless steel screens are interposed between the sealed container and the storage volume so as to remove sulphur from the gaseous by-products.

DETAILED DESCRIPTION OF THE INVENTION

Figure 1:
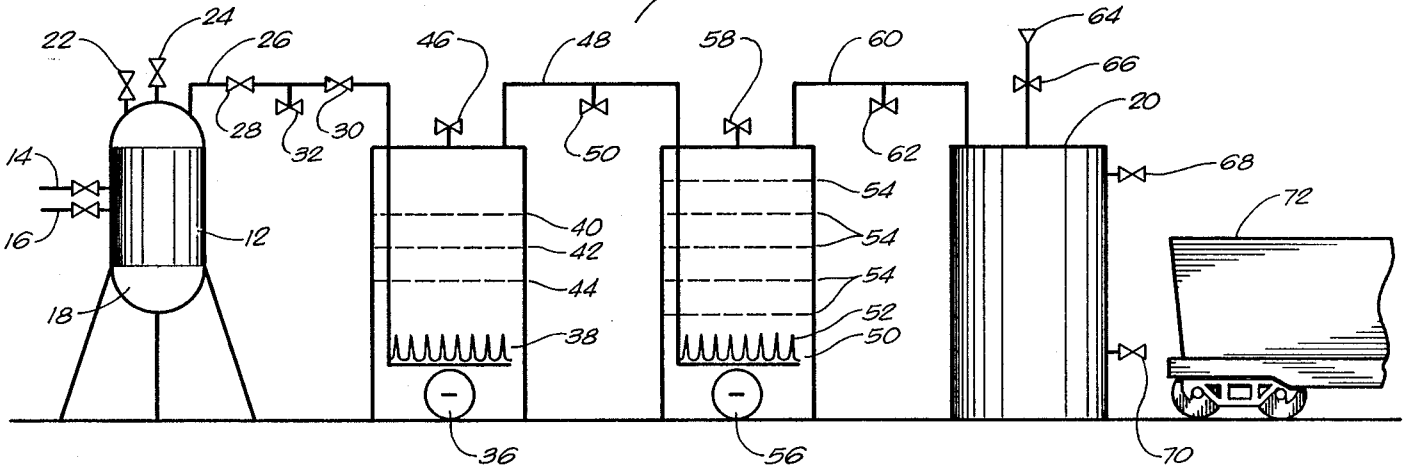
FIG. 1 is a schematic representation of the process and apparatus of the present invention.

Referring to FIG. 1, there is shown at 10 the waste disposal system in accordance with the preferred embodiment of the present invention. Specifically, the waste disposal system 10 includes sealed container 12, waste delivery channel 14, inert gas injector 16, heater 18, and storage vessel 20.

Sealed container 12 is the apparatus that receives the waste. Sealed container 12 acts as the receptacle for the waste and for the gasifying of such waste. As described herein, the container 12 is "sealed" since container 12 is part of a closed system.

Sealed container 12 receives waste into its interior from the waste transport channel 14. In the preferred embodiment of the present invention, the waste that is delivered into the sealed container 12 is a liquid organic waste. Although this is specified in the preferred embodiment of the present invention, the present invention will achieve its same results with solid waste and with inorganic wastes. The present system can be used to dispose of garbage.

The inert gas injector 16 is positioned so as to communicate with the interior of the sealed container 12 in a valved relationship. Specifically, the inert gas injector may be selectively activated so as to fill the container 12 with nitrogen and to expel any oxygen remaining within the container 12. In the preferred embodiment of the present invention, nitrogen is the inert gas to be injected into the interior of container 12.

The heater 18 is an induction heater that has the capacity to cause the interior of sealed container 12 to exceed 2,700° F. in temperature. The induction heater 18 is shown, in FIG. 1, as positioned beneath the sealed container 12. However, in alternative embodiments of the present invention, the heater 18 may be positioned elsewhere. The only important requirement of the heater 18 of the present invention is that it generate a suitable temperature in an oxygen-free environment to gasify any waste delivered into the interior of container 12. A thermocouple 22 is connected to the container 12 so as to monitor the interior temperature of container 12. Thermocouple 22 is any of a variety of suitable pyromers that have the capacity to measure temperatures in excess of 2,700° F. Oxygen analyzer 24 is also connected to container 12 so as to measure the oxygen content of the atmosphere within container 12. Since it is important to the concept of the present invention that the destruction of the waste occur in an oxygen-free environment, the oxygen analyzer 24 is required so as to provide an indication of when the oxygen is effectively purged from the interior of container 12.

Line 26 communicates with the interior of sealed container 12 so as to cause the gaseous composition produced by the dissociation of the waste materials to pass from container 12. After the liquid waste has been effectively dissociated within container 12, the resulting complex composition of gases will pass outwardly from the container 12 through line 26. Temperature gage 28 and pressure gage 30 are positioned on line 26 to appropriately monitor the environmental conditions. A sampler 32 is also provided along line 26 so as to monitor and sample the gases passing through line 26. Since the composition of the liquid waste introduced into container 12 can have a wide variety of components, it is useful and necessary to monitor the complex composition of the gas as it passes through line 26. Line 26 extends from the container 12 to a water filter 34. Water filter 34 includes an access opening 36 that can be utilized so as to access the interior of water filter 34 and so as to remove any solid materials that are filtered from the gaseous composition. Initially, the gaseous composition is aerated by aerator 38. Aerator 38 causes a wide distribution of the gaseous composition to pass evenly through water filter 34. A plurality of stainless steel screens 40, 42, and 44 are positioned within water filter 38 such that the gaseous composition, as aerated, will flow upwardly through water filter 38 and pass through stainless steel screens 40, 42 and 44. Stainless steel screens 40, 42 and 44 serve to trap and remove sulphur and other particulate matter that may reside within the gaseous composition passing through water filter 34. Water filter 34 causes the carbon black, the carbon dioxide, and the carbon monoxide of the gaseous composition to mix with the water so as to become carbonic acid and carbon black in solution. It also serves to cool the gaseous composition passing therethrough. A vent 46 is provided so as to prevent any pressure build-up.

The water filtered gaseous composition then passes from water filter 34 into pipe 48. Pipe 48 is a stainless steel pipe that has a sufficient capacity to allow the gaseous composition to pass freely therethrough. A sampler 50 is connected to pipe 48 so as to allow samples to be taken of the gaseous composition passing through pipe 48. Pipe 48 extends into sodium hydroxide filter 50. The gaseous composition from pipe 48 is aerated by aerator 52 such that the gaseous composition will pass from aerator 52 upwardly through sodium hydroxide filter 50. A plurality of stainless steel screens 54 are positioned across the sodium hydroxide filter 50 so as to remove sulphur and other particulate matter from the gaseous composition. As the gaseous composition passes through the sodium hydroxide sOlution within the sodium hydroxide filter 50, the chlorine in the gaseous composition will be converted into a salt. The salt, in solid form, may be removed, as needed, through access opening 56 in sodium hydroxide filter 50. A vent 58 is provided on sodium hydroxide filter 50 so as to prevent problems from pressure build-up.

After the gaseous composition has passed through the sodium hydroxide solution within the sodium hydroxide filter 50, the gaseous composition will pass into pipe 60. Pipe 60 is a stainless steel pipe that extends from the sodium hydroxide filter 50 to storage tank 20. Storage tank 20 receives the gaseous composition, as filtered, from pipe 60. A sampler 62 is provided on pipe 60 so as to allow the operator of the system to take periodic samples of the gaseous composition passing through pipe 60. Storage tank 20 includes a flare 64 or a secondary source for heat. Storage tank 20 also includes a pressure release valve 66 so as to prevent unnecessary pressure build-up. A sampler 68 is provided on the storage tank 20 so as to allow the operator of the system to take periodic samples of the gaseous composition contained within storage tank 20.

Storage tank 20 includes the gaseous composition having many compounds. In their combined form, these gases are relatively valueless. However, a molecular sieve 70 is connected to the storage tank 20 so as to allow the gases to be separated and removed from storage tank 20. The molecular sieve 70 allows the gases to be separated into their individual components. For example, molecular sieve 70 may be of a type that only allows ethylene to pass therethrough and from storage tank 20. As can be seen in FIG. 1, such a selected gas will then pass into a tanker truck 72 so as to be shipped and sold to a designated location. Tanker truck 72 can be utilized for a single gas or can be a multiple container truck for receiving an assortment of separated gases. The ability to produce and sell the gases resulting from the process of the present invention allows the process to be economical. Ultimately, the value of the gases produced from the initial waste should exceed the cost of operating the system of the present invention.

The process of the present invention involves the steps of (1) passing a waste through line 14 into sealed container 12; (2) purging the oxygen from within sealed container 12; (3) heating the interior of the container 12 to a temperature of greater than 2700° F. so as to convert the waste material into a gaseous composition; and (4) transmitting this gaseous composition into the storage vessel 20.

In the preferred embodiment of the present invention, the waste is a liquid organic waste that can be pumped, by way of pipe 14, into the interior of container 12. The oxygen within container is purged by introducing an inert gas through line 16 into the interior of container 12. As the inert gas (e.g. nitrogen) is injected into the container 12, the oxygen will pass from the interior of the container. Alternatively, the oxygen can be expelled from the container as the nitrogen is being introduced. While the inert ga is being injected until container 12, the oxygen content of the interior of container 12 is continually monitored by oxygen analyzer 24. Additionally, the temperature of the interior of container 12 is monitored by thermocouple 22.

Heat is applied to the interior of container 12 by induction heating. Specifically, and ideally, the interior of container 12 will be heated to a temperature of between 2700° and 3500° F. The temperature in this range will allow all hydrocarbons to become dissociated and be converted into gaseous composition. Although higher temperatures than this may be possible, it is believed that higher temperature would be additionally costly and have adverse consequences to the economic benefit of the process of the present invention. Since the waste is being gasified in an oxygen-free environment, the oxygen is not available to cause pollution. By the process of the present invention, carbon dioxide, carbon monoxide, chlorine and sulphur dioxides are not released. Inert gases will not combine with dissociated molecules so as to form pollutants. Since the container is operated at superhigh temperatures, there is no possibility of clinkers being produced, and deterious material, such as polychlorinated biphenyl, which is considered difficult to decompose, is completely decomposed into a harmless gas. Nitrogen oxide is not produced because of the operation of the system in an oxygen-free environment. In the system of the present invention, there is no oxygen existing in the system, except for the brought in with the waste charged into the container. As a result, little oxygen exists within the container and, if it exists, it is very low in concentration. Since oxygen reacts with hydrocarbon and hydrogen sooner than with nitrogen, no nitrogen monoxide is allowed to be produced. In addition, since the effects of nitrogen on the molecule of the waste becomes smaller in proportion to an increase in temperature, no nitrogen oxide is produced.

When the gaseous composition has been produced by the superhigh temperatures of container 12, the gas passes through water filter 34 so as to remove a portion of the carbon content of the gas. The gaseous composition is then passed from the water filter 34 through a sodium hydroxide filter 50 so as to remove a portion of the chlorine component of the gas. Ideally, the resultant solids produced by these filtering processes can be removed through the access openings 36 and 56 of the respective filters.

The remaining gaseous composition then passes into storage vessel 20. Storage vessel 20 has equipment with appropriate molecular sieves so as to allow the removal of the specific gases of the gaseous composition.

In experiments conducted with the process of the present invention, readings were taken of the resultant gas composition that would pass into the storage vessel 20 of the process of the present invention. Table I, hereinbelow, shows a breakdown of the gas composition. Of particular note, no oxygen was detected as part of the composition. Importantly, very valuable gases, such as methane, propane, and ethylene, were produced by the burning of a liquid organic waste.

TABLE I

| | |
|---|---|
| HYDROGEN | 34.60 Mol. % |
| CARBON DIOXIDE | 6.22 Mol. % |
| ETHYLENE | 8.52 Mol. % |
| ETHANE | 2.35 Mol. % |
| ACETYLENE | 0.15 Mol. % |
| OXYGEN | NONE DETECTED |
| NITROGEN | 0.70 Mol. % |
| METHANE | 25.53 Mol. % |
| CARBON MONOXIDE | 6.22 Mol. % |
| PROPANE PLUS | 15.71 Mol. % |

Another analysis was conducted of the burning of garbage introduced into the container. Table II shows the specific breakdown of the resultant gases that would be found in the storage vessel 20. In Table II, it can be seen that valuable gases, such as ethYlene, methane and propane, were produced from the process of the present invention.

TABLE II

| | |
|---|---|
| HYDROGEN | 30.291 Mol. % |
| CARBON DIOXIDE | 14.187 Mol. % |
| ETHYLENE | 8.064 Mol. % |
| ETHANE | 0.913 Mol. % |
| ACETYLENE | 0.429 Mol. % |
| HYDROGEN SULFIDE | NONE DETECTED |
| OXYGEN | NONE DETECTED |
| NITROGEN | 0.477 Mol. % |
| METHANE | 10.802 Mol. % |
| CARBON MONOXIDE | 26.254 Mol. % |
| PROPANE PLUS | 8.583 Mol. % |

It can be seen from the present invention that the present invention achieves a pollution-free destruction of waste. Since the destruction of the waste occurs in an oxygen-free environment, there is no pollution to be released into the atmosphere. Furthermore, the production of valuable gases from the process of the present invention allows such gases to be sold separate and apart from the destruction process itself. The value of such gases, at least, economically offsets the cost of the operation of the waste destruction system of the present invention. In prior art systems, the heat necessary to gasify the waste would be too costly for economic consideration. In the present invention, this cost is greatly offset by the value of the produced gaseous by-products of the process.

The foregoing disclosure and description of the invention is illustrative and explanatory thereof, and various changes in the method steps, as well as in the details of the illustrated apparatus, may be made within the scope of the appended claims without departing from the true spirit of the invention. The present invention should be limited by the following claims and their legal equivalents.

I claim:

1. A process for the disposal of waste comprising the steps of:

passing a waste into a sealed container;

introducing an inert gas into the interior of said sealed container so as to displace oxygen from within said sealed container;

analyzing the oxygen content of the interior of said sealed container while said inert gas is introduced into said sealed container;

heating the interior of said sealed container to a temperature of greater than 2700° F. so as to convert that waste into a gas; and transmitting said gas into a storage vessel.

2. The process of claim 1, said waste being a liquid organic water.

3. The process of claim 1, said step of purging further comprising:

expelling said oxygen from said sealed container while said insert gas is introduced.

4. The process of claim 1, said inert gas being nitrogen.

5. The process of claim 1, said step of heating comprising:

applying heat to said sealed container by induction heating.

6. The process of claim 1, said step of heating comprising:

heating the interior of said sealed container to between 2,700° and 3,500° F.

7. The process of claim 1, further comprising the step of:

transferring said gas through a water filter so as to remove a portion of the carbon component of said gas.

8. A process for the disposal of waste comprising the steps of:

passing a waste into a sealed container;

purging said sealed container of oxygen;

heating the interior of said sealed container to a temperature of greater than 2700° F. so as to convert that waste into a gas;

transferring said gas through a water filter so as to remove a portion of the carbon component of said gas;

passing the water-filtered gas through a sodium hydroxide filter so as to remove a portion of the chlorine component of said gas; and transmitting said gas into a storage vessel.

9. A process for the disposal of waste comprising the steps of:

passing a waste into a sealed container;

purging said sealed container of oxygen;

heating the interior of said sealed container to a temperature of greater than 2700° F. so as to convert that waste into a gas;

transmitting said gas into a storage vessel;

sieving said gas so as to remove various gaseous components from said gas; and directing the sieved gas into separate containers corresponding to each of said gaseous components.

10. An apparatus for the disposal of waste comprising:

a sealed container;

a waste transport means communicating with the interior of said sealed container, said waste transport means for delivering waste to the interior of said sealed container;

an inert gas injection means communicating with the interior of said sealed container for delivering an inert gas to the interior of said sealed container;

heating means adjacent said sealed container so as to cause the interior of said sealed container to exceed 2,700° F. in temperature;

a storage vessel connected to said sealed container so as to receive the gaseous by-products from said sealed container; and a sodium hydroxide filter means connected between said storage vessel and said sealed container for filtering the chlorine component of said gaseous by-products.

11. The apparatus of claim 10, further comprising:

oxygen removal means connected to said sealed container so as to allow oxygen to pass from said sealed container upon the introduction of an inert gas from said inert gas injection means.

12. The apparatus of claim 10, further comprising:

water filter means connected between said storage vessel and said sealed container for filtering the carbon components of said gaseous by-products.

13. The apparatus of claim 10, said heating means comprising:

an induction heater connected to said sealed container for causing an oxygen-free temperature of between 2,700° and 3,500° F. within said sealed container.

14. The apparatus of claim 10, said waste transport means comprising:

a pipe for directing liquid organic waste into the interior of said sealed container.

15. The apparatus of claim said inert gas being nitrogen.

16. An apparatus for the disposal of waste comprising:

a sealed container;

a waste transport means communicating with the interior of said sealed container, said waste transport means for delivering waste to the interior of said sealed container;

an inert gas injection means communicating with the interior of said sealed container for delivering an inert gas to the interior of said sealed container;

heating means adjacent said sealed container so as to cause the interior of said sealed container to exceed 2,700° F. in temperature; and a storage vessel connected to said sealed container so as to receive the gaseous by-products from said sealed container, said storage vessel having a molecular sieve attached thereto, said molecular sieve for the selective removal of desired gases from said storage vessel.

17. An apparatus for the disposal of waste comprising:

a sealed container;

a waste transport means communicating with the interior of said sealed container, said waste transport means for delivering waste to the interior of said sealed container;

an inert gas injection means communicating with the interior of said sealed container for delivering an inert gas to the interior of said sealed container;

heating means adjacent said sealed container so as to cause the interior of said sealed container to exceed 2,700° F. in temperature;

a storage vessel connected to said sealed container so as to receive the gaseous by-products from said sealed container; and a plurality of stainless steel screens interposed between said sealed container and said storage vessel, said stainless steel screens for removing sulphur from said gaseous by-products.

* * * * *